US006894595B2

(12) United States Patent
Howell

(10) Patent No.: US 6,894,595 B2
(45) Date of Patent: May 17, 2005

(54) MAGNETICALLY OPERATED HINGE SWITCH

(75) Inventor: Antony Howell, North Lopham (GB)

(73) Assignee: Key Safety Systems, Inc., Sterling Heights, MI (US)

( * ) Notice: Subject to any disclaimer, the term of this patent is extended or adjusted under 35 U.S.C. 154(b) by 0 days.

(21) Appl. No.: 10/617,717

(22) Filed: Jul. 14, 2003

(65) Prior Publication Data

US 2004/0217835 A1 Nov. 4, 2004

(30) Foreign Application Priority Data

Apr. 14, 2003 (GB) ..... 0308620

(51) Int. Cl.[7] ..... H01H 9/00
(52) U.S. Cl. ..... 335/205; 335/151
(58) Field of Search ..... 335/205–207, 335/151–153

(56) References Cited

U.S. PATENT DOCUMENTS 3,924,631 A * 12/1975 Mancusi, Jr. ..... 600/30
6,060,969 A * 5/2000 Hufgard et al. ..... 335/207
6,175,290 B1 * 1/2001 Forsythe et al. ..... 335/207

OTHER PUBLICATIONS

"59200 Lever Arm Sensor Features and Benefits," Breed Electronics data sheet, 2000.

"59230 Robust Lever Arm Sensor Features and Benefits" Hamlin data sheet, 2001.

* cited by examiner

*Primary Examiner*—Lincoln Donovan
(74) *Attorney, Agent, or Firm*—Lonnie Drayer; Patrick Stiennon

(57) ABSTRACT

A switch has a unitary plastic body that can be formed by injection moulding or extrusion. The body has a base that holds a magnetic field sensor. The base is fastened to a support structure by a plurality of fasteners. The base is connected to an arm by an elastic U-shaped portion of the plastic body that acts as both a hinge and a biasing member. The arm positions an activation magnet over the base and the sensor. The arm does not block access to fasteners that mount the switch to the support structure.

17 Claims, 1 Drawing Sheet

MAGNETICALLY OPERATED HINGE SWITCH

FIELD OF THE INVENTION

The present invention relates to switches used to detect the closing of a door or lid where two parts of the switch connected by a hinge are moved towards each other.

BACKGROUND OF THE INVENTION

In many applications it is desirable to be able to positively detect that a certain action has taken place, for example that the hood of a car has been properly closed. Prior art devices are usually comprised of a base that contains a sensor and an arm that is mounted by a hinge to the base that contains a means for interacting with the sensor. These prior art devices typically require three or more separate parts and a metal biasing means for keeping the sensor open. The metal biasing means can often be exposed to corrosion depending on the environment of the use. What is needed is a hinge type switch of simpler and more robust construction.

SUMMARY OF THE INVENTION

The hinge switch of this invention has a unitary plastic body that can be formed by injection moulding or extrusion. The unitary plastic body has a base that can be fastened to a support structure by a plurality of fasteners that pass through the base and through the support structure. The base is connected to an arm by an elastic U-shaped portion of the plastic body that acts as both a hinge and a biasing member. The U-shaped portion is substantially thinner and thus more flexible than the base or the arm. The base has an end face into which is formed a sensor-receiving cavity. Positioned within the cavity is a sensor module that is connected by wire leads to a connector plug. The sensor module contains a magnetic field sensor such as a reed switch or Hall effect sensor. The arm is less wide than the base so that it does not block access to the plurality of fasteners that mount to the base to the support structure. The arm has portions defining an opening into which an activation magnet is placed.

It is a feature of the present invention to provide a switch of unitary construction.

It is a further feature of the present invention to provide a hinge switch wherein the material of the hinge elastically biases the switch to an open position.

It is another feature of the present invention to provide a hinge switch that is not subject to corrosion.

Further features and advantages of the invention will be apparent from the following detailed description when taken in conjunction with the accompanying drawings.

DETAILED DESCRIPTION OF THE INVENTION

Figures 1, 2:
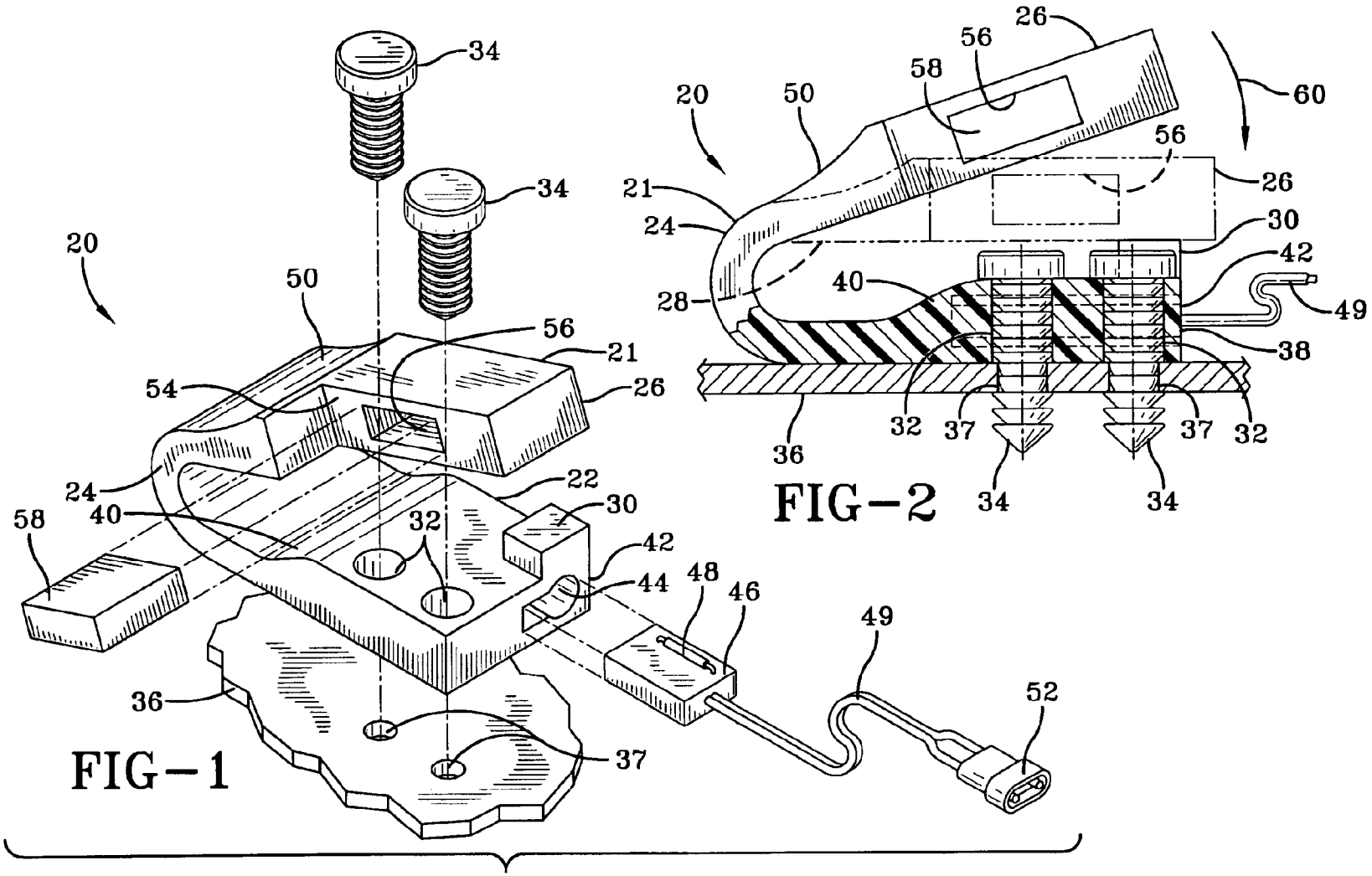
FIG. 1 is an exploded isometric view of the lever arm sensor of this invention.
FIG. 2 is a side elevational view partially cut away in section, of the lever arm sensor of FIG. 1.

Referring more particularly to FIGS. 1–2 wherein like numbers refer to similar parts, a lever arm switch 20 is shown in FIGS. 1 and 2. The lever arm switch 20 has a plastic body 21 which includes a base 22, a hinge 24, and a closure arm 26 which are integrally formed of plastic, for example polypropylene, as a single injection moulded piece. The hinge 24 takes on a smooth U-shaped form 28 as illustrated in FIG. 2 when the closure arm 26 is brought into engagement with a stop 30 which is integral with the base 22 and the entire switch 20.

The base 22 has two mounting holes 32 into which fasteners 34 are positioned to hold the base 22 fixed with respect to a mounting structure 36 by passing through the holes 32 in the base and into corresponding holes 37 in the mounting structure. The base 22 has a thick section 38 that is joined by a smooth transitional section 40 to the hinge 24. The mounting holes 32 pass vertically downwardly through the thick section 38 of the base. The base 22 has an overall rectangular shape with an end face 42 opposite the hinge 24 into which is formed a sensor cavity 44. The stop 30 is positioned above the sensor cavity 44. A sensor module 46 is positioned within the sensor cavity 44. The sensor module 46 contains a magnetic field sensor 48 which may be a reed switch, a Hall effect sensor, a GMR sensor, an induction coil or other means of detecting an electromagnetic field. The sensor is connected to a two or more wire leads 49 that terminate in a connector plug 52.

The closure arm 26 is connected to an upper transition section 50 but does not extend along the entire transition section 50 so that the arm 26 does not overlie the mounting holes 32 in the base 22 allowing access to install or remove the fasteners 34. Thus the arm 26 and the transition section 50 define a rectangular open space 54 which allows vertical access to the mounting fasteners 34. The closure arm 26 has portions defining a cavity 56 into which in activation magnet 58 is bonded or insertion moulded. The magnet 58 is positioned so as to activate, or be detected by the magnetic field sensor 48 within the sensor module 46 positioned within the sensor cavity 44 within the base 22. The stop 30 limits the motion of the closure arm 26, as shown in FIG. 2 and positions the activation magnet 58 to be detected by the magnetic field sensor 48 within the sensor module 46 which is mounted in the sensor cavity 44.

The closure arm 26 and the base 22 are about the same thickness, and are connected by the lower transition section 40 and the upper transition section 50 to the hinge 24 which has about one-half the thickness of the closure arm 26 and the base 22. The greater thickness of the base 22 and the closure arm 26 means that substantially all elastic deformation caused by the motion of the closure arm downwardly, as indicated by arrow 60, occurs in the hinge 24. The smooth transition sections 40, 50 provide a gradual transition between the flexible hinge 24 and the substantially rigid base 22 and closure arm 26. The gradual transition prevents stress concentrations caused by the change in section between the base 22 and the arm 26 and the hinge 24. The minimization of stress concentrations results in a relatively low stressed hinge 24 with a flexure of about 30 degrees or less and the use of a suitable plastic such as polypropylene will produce a switch with a desirable long life.

It should be understood that while the hinge switch 20 is preferably formed as a single injection moulded part it could be cut from a continuous extrusion. It should also be understood that the activation magnet 58 and the sensor module 46 could be mounted to the hinge switch 20 by moulding-in-place, bonding, or by being potted, heat staked or fastened to the switch body 21. It should also be understood that if a reed switch is used as the magnetic field sensor, it could be of the type that is normally open, or the type which is normally closed. Without thickness discontinuity, should be under stood to mean a gradual, smooth transition to avoid producing a stress concentration.

While the invention has been explained with reference to the specific embodiments of the invention, the explanation is illustrative and the invention is limited only to the appended claims.

I claim:

1. A switch comprising:

a single piece plastic hinge, the hinge having a base portion and flexible section which extends between the base portion and an arm portion extending over the base portion;

a magnetic field sensor mounted to the base portion; and an activation magnet mounted to the arm portion, the flexible section elastically biasing the arm portion and the actuation magnet away from the magnetic field sensor mounted to the base portion so that the magnetic field sensor is activated by elastically pushing the arm portion towards the base portion.

2. The switch of claim 1 wherein the base portion has portions forming a stop which extends upwardly from the base portion, and which engages the arm when it is moved downwardly towards the base, thus limiting the travel of the arm towards the base.

3. The switch of claim 1 wherein the base portion transitions without thickness discontinuity into the hinge portion which is approximately one-half as thick as the base portion, and the hinge portion transitions without thickness discontinuity into the arm portion which is about as thick as the base portion.

4. The switch of claim 1 wherein the base portion has at least one fastener hole, and wherein the arm portion does not extend over the at least one fastener hole.

5. The switch of claim 1 wherein the magnetic field sensor is a Hall effect sensor.

6. The switch of claim 1 wherein the magnetic field sensor is a reed switch.

7. The switch of claim 1 wherein portions of the arm portion form a magnet receiving cavity in which the activation magnet is positioned.

8. The switch of claim 1 wherein the plastic hinge is constructed of polypropylene.

9. A switch comprising:

a single piece plastic hinge body;

a base forming a portion of the plastic hinge body, the base being mounted to a support structure by a plurality of fasteners extending through the base;

a U-shaped hinge integrally formed with the base;

an arm integrally formed with the base and the U-shaped hinge, wherein the U-shaped hinge extends between the base and the arm, and wherein the arm extends over at least a portion of the base;

a magnetic field sensor mounted to the base; and an activation magnet mounted to the arm, the U-shaped hinge elastically biasing the arm portion and the activation magnet away from the magnetic field sensor mounted to the base so that the magnetic field sensor is activated by elastically pushing the arm portion towards the base.

10. The switch of claim 9 wherein the base has portions forming a stop which extends upwardly from the base, towards the arm, and which engages the arm when it is moved downwardly towards the base, the stop limiting the travel on the arm towards the base.

11. The switch of claim 9 wherein the base transitions without thickness discontinuity into the U-shaped hinge which is substantially less thick than the base, and the U-shaped hinge transitions without thickness discontinuity into the arm portion which is about as thick as the base.

12. The switch of claim 9 wherein the base has portions defining at least one fastener hole, and wherein the arm does not extend over the at least one fastener hole.

13. The switch of claim 9 wherein the base has an end face opposite the U-shaped hinge, and wherein portions of the base form a sensor cavity into which the magnetic field sensor is placed.

14. The switch of claim 9 wherein the magnetic field sensor is a Hall effect sensor.

15. The switch of claim 9 wherein the magnetic field sensor is a reed switch.

16. The switch of claim 9 wherein portions of the arm form a magnet receiving cavity in which the activation magnet is positioned.

17. The switch of claim 9 wherein the extruded plastic hinge body is constructed of polypropylene.

* * * * *